US011638849B1

(12) United States Patent
Rimes

(10) Patent No.: US 11,638,849 B1
(45) Date of Patent: May 2, 2023

(54) WATER WEIGHT TRAINING DEVICE

(71) Applicant: Jeff Rimes, Lake Butler, FL (US)

(72) Inventor: Jeff Rimes, Lake Butler, FL (US)

( * ) Notice: Subject to any disclaimer, the term of this patent is extended or adjusted under 35 U.S.C. 154(b) by 0 days.

(21) Appl. No.: 17/462,262

(22) Filed: Aug. 31, 2021

Related U.S. Application Data

(60) Provisional application No. 63/180,525, filed on Apr. 27, 2021.

(51) Int. Cl.
*A63B 21/06* (2006.01)
*A63B 21/072* (2006.01)

(52) U.S. Cl.
CPC ..... *A63B 21/0602* (2013.01); *A63B 21/0724* (2013.01); *A63B 21/0726* (2013.01); *A63B 2208/03* (2013.01)

(58) Field of Classification Search
CPC ..... A63B 21/0602; A63B 21/0724; A63B 21/0726; A63B 21/0606; A63B 21/072; A63B 21/0722; A63B 21/0728; A63B 21/075; A63B 21/4023; A63B 21/4019; A63B 21/4021; A63B 21/4043; A63B 2208/03; A63B 23/1209
See application file for complete search history.

(56) References Cited

U.S. PATENT DOCUMENTS 5,184,993 A * 2/1993 Dowdeswell ..... A63B 21/072 482/106
5,431,615 A * 7/1995 Correll ..... A63B 21/0602 446/267
5,842,957 A * 12/1998 Wheeler ..... A63B 21/0602 482/106
5,967,952 A * 10/1999 Bronstein ..... A63B 21/0606 482/106
6,939,276 B2 * 9/2005 Gates ..... A63B 21/0606 482/106
2017/0282001 A1 * 10/2017 Imbert ..... A63B 1/00

* cited by examiner

*Primary Examiner* — Megan Anderson
(74) *Attorney, Agent, or Firm* — C. Richard Lohrman; Lohrman IP Law LLC

(57) ABSTRACT

The invention presented is an aquatic weight training device that enables weight training in an aquatic environment while allowing eccentric weight training. The inventive device includes at least one hollow bar with hollow weights attached at each end. The end weights each include a plurality of holes that allow a user to fill the end weights under water then controllably empty the end weights while exercising. The end weights may be fixedly or releasably attached to the bar.

12 Claims, 9 Drawing Sheets

WATER WEIGHT TRAINING DEVICE

CROSS REFERENCE TO RELATED APPLICATIONS

This patent application claims the benefit under 35 U.S.C. § 119(e) of U.S. Provisional Application No. 63/180,525, filed Apr. 27, 2021, which application is incorporated herein by reference in its entirety.

FIELD OF THE INVENTION

The field of the invention generally pertains to weight training, more particularly to weight training in an aquatic environment, and still more particularly to eccentric weight training in an aquatic environment.

BACKGROUND OF THE INVENTION

Information concerning exercise and general overall fitness is increasing almost exponentially as both professionals and lay persons learn more about how different types of exercise affect the body and overall health. This increased awareness includes the area of weight and resistance training. It has long been known that weight training increases muscle mass, strength and raises metabolic rate among other benefits.

One form of weight training is eccentric training which entails resistance applied to a muscle as it stretches under load. An example is found with an exercise called the bicep curl. When a person curls a dumbbell toward the chest, the bicep contracts. If the person lowers the dumbbell slowly rather than let it drop, resistance is applied to the bicep as it lengthens. Essentially, eccentric training is resistance to gravity, such as when the lowering of the dumbbell is resisted (e.g., taking 5 seconds to lower the dumbbell completely). It has been found it is particularly helpful for injured persons and the elderly as it requires less force than concentric training to increase muscle mass and strength.

There is also an increased awareness of aquatic exercise performed in pools, lakes, ponds, etc. Among other factors, water provides support to individuals while they exercise, helps with back problems, reduces the possibility of injury, and helps reduce the effects of arthritis on the ability to exercise to the greatest extent possible.

People have tried to combine the benefits of weight training with the support supplied by an aquatic setting. Usually, the weight is in the form of a foam rubber device such as a dumbbell. This creates resistance as long as the device is under water. However, a foam rubber device provides no resistance when it is lifted out of the water which is the end result of most movements in the water. In addition, eccentric movements cannot be performed with the weight under water as the water negates the effect of gravity. Consequentially, the aquatic environment that would be beneficial for elderly and injured people does not allow for the most beneficial type of resistance training for those groups of people.

Thus, there is a need in the field for a device or devices that allow for weight training, including eccentric training, in an aquatic setting.

SUMMARY OF THE INVENTION

The current invention broadly comprises an aquatic weight training device comprising: at least one hollow bar having first end and a second end; a pair of hollow end weights in which one of the pair of hollow end weights is attached to the first end of the at least one bar and one of the pair of hollow end weights is attached to the second end of the at least one bar; wherein each hollow end weight includes a pair of end caps attached to and enclosing each one of the pair of hollow end weights; and a plurality of holes defined by one side of each of the pair of end weights. A liquid may be poured into the at least one hollow bar through at least one of the pair of hollow end weights.

In an alternate embodiment, the invention the at least one bar comprises two hollow bars each having a first end and a second end. Each of the first ends is attached to an end weight while each of the second ends is attached to a middle weight. In a second alternative embodiment, the end weights are releasably attached to the at least one bar by a lock ring.

One object of the invention is to provide a suitable weight training device that will allow the user to take advantage of an aquatic environment.

A second object of the invention is to depict a weight training device that increases user control over eccentric weight training.

A third object of the invention is to supply an aquatic weight training device that enables both concentric and eccentric weight training exercises.

A fourth object of the invention is to show an aquatic weight training device allows for adjusting the total weight lifted by a user.

BRIEF DESCRIPTION OF THE SEVERAL VIEWS OF THE DRAWINGS

The nature and mode of the operation of the present invention will now be more fully described in the following detailed description of the invention taken with the accompanying drawing Figures, in which.

DETAILED DESCRIPTION OF EMBODIMENTS OF THE INVENTION

At the outset, it should be appreciated that like drawing numbers on different drawing views identify identical structural elements of the invention. It also should be appreciated that figure proportions and angles are not always to scale in order to clearly portray the attributes of the present invention.

While the present invention is described with respect to what is presently considered to be the preferred embodiments, it is understood that the invention is not limited to the disclosed embodiments. The present invention is intended to cover various modifications and equivalent arrangements included within the spirit and scope of the appended claims.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "substantially" is synonymous with terms such as "nearly", "very nearly", "about", "approximately", "around", "bordering on", "close to", "essentially", "in the neighborhood of", "in the vicinity of", etc., and such terms may be used interchangeably as appearing in the specification and claims. It should be appreciated that the term "proximate" is synonymous with terms such as "nearby", "close", "adjacent", "neighboring", "immediate", "adjoining", etc., and such terms may be used interchangeably as appearing in the specification and claims. Although any methods, devices or materials similar or equivalent to those described herein can be used in the practice or testing of the invention, the preferred methods, devices, and materials are now described.

Figure 1:
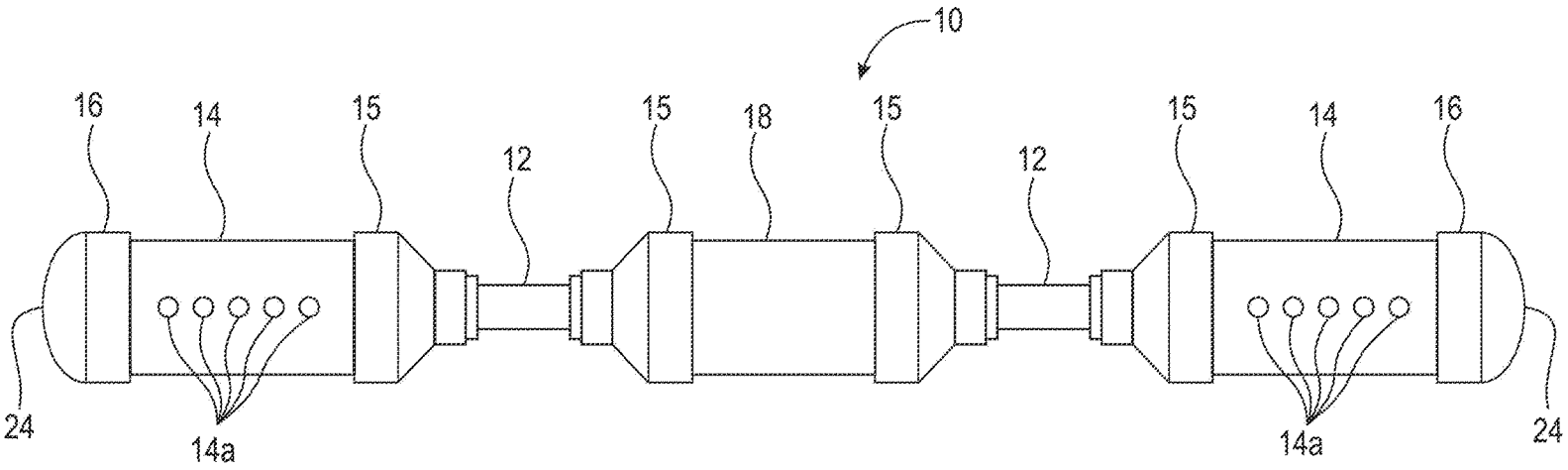
FIG. 1 is a front view of the water weight training device of the present invention.

FIG. 1 is a front view of water weight training device 10 (device 10") of the present invention. Bar 12 supports end weights 14 at each end of bar 12. In the embodiment shown, middle weight 18 is supported by at least one bar 12. Bar 12 and end weights 14 are hollow to allow them and middle weight 18 to be filled with water as explained below.

Reducers 15 are attached to one end of end weights 14 and to each end of middle weight and receive bar(s) 12. End caps 16 ("caps 16") are attached to the end of each end weight 14. Reducers 15 and end caps 16 may be fixedly attached to bar 12 and end weight 14, respectively, as with glue or other adhesives or may be releasably attached with collar lock rings as described below. In a preferred embodiment, end caps 16 and reducers 15 may have the same size and configuration making them interchangeable and fabrication more efficient. Optionally, end caps 16 may have end plugs 24 (not seen in FIG. 1) that are releasably attached to end caps 16 and allow water to be poured into or drained from device 10 when removed from one or both of end caps 16.

Figure 1A:
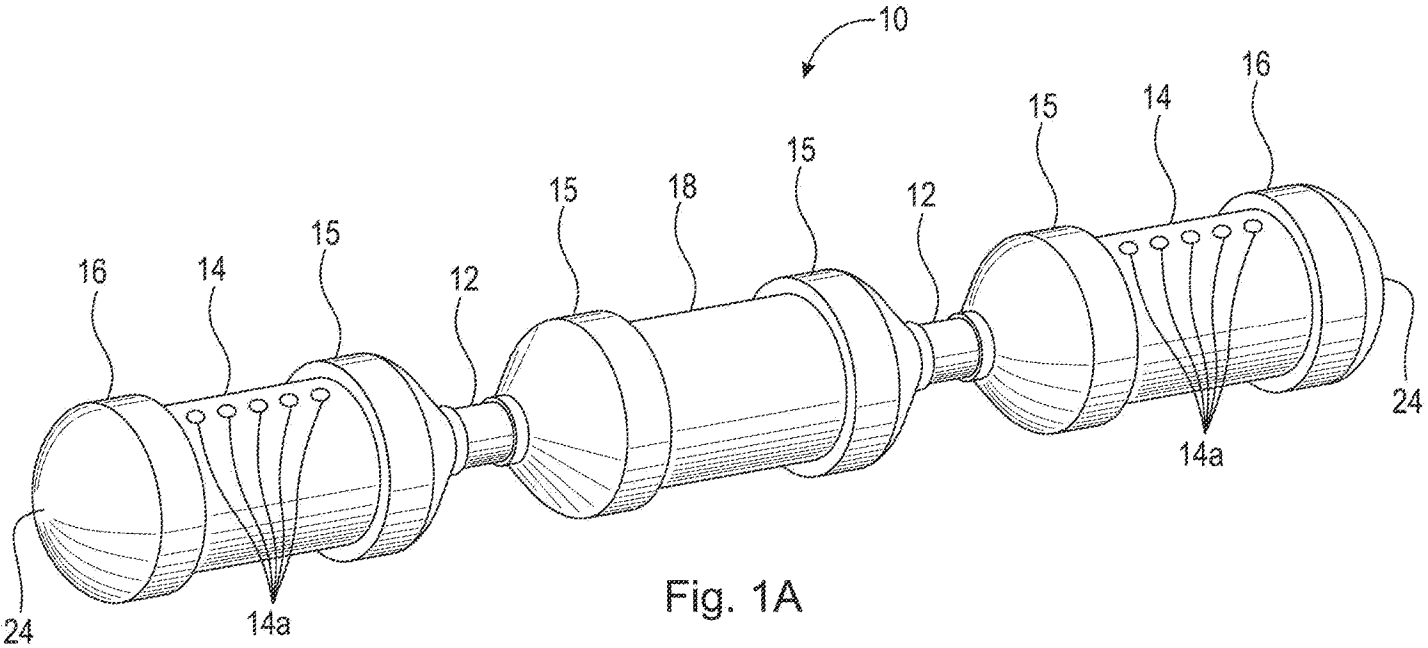
FIG. 1A is a top perspective view of the water weight training device showing the plurality of holes in each end weight in line with each other.

In some embodiments, bar 12 may be two or more separate bars with one bar 12 attached at one bar end to one end weight 14 and at the other end to middle weight 18 with a second bar 12 attached to a second end weight 14 and the other end of middle weight 18. This embodiment allows for a longer device 10 that forms a type of barbell as seen in FIG. 1. Each end weight 14 defines a plurality of holes 14*a* that allow end weights 14 to fill quickly with water when device 10 is submerged. Holes 14*a* are positioned so that they form a straight line across the length of end weight 14. FIG. 1A is a top perspective view of the water weight training device showing a preferred embodiment in which end weights 14 are attached to bar 12 such that the plurality of holes 14*a* are on the same side of each end weight 14 so as to have both end weights 14 hold the same amount of water when each of holes 14*a* face upward.

Figure 2:
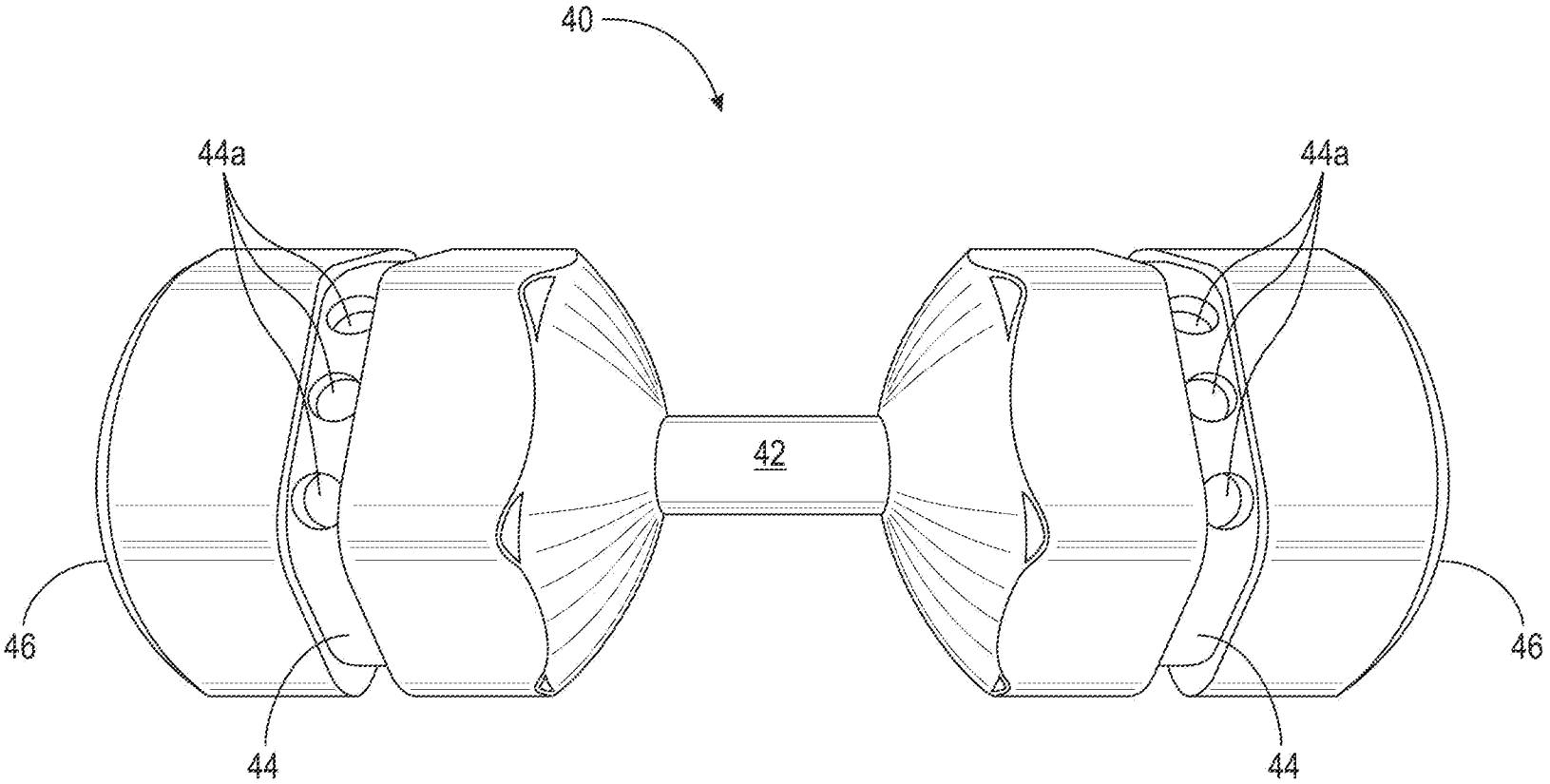
FIG. 2 is a top perspective view of a dumbbell type of water weight training device.

Alternatively, a shorter hollow single bar 42 may be attached to two hollow end weights 44 to form a dumbbell 40 as seen in FIG. 2. As with device 10, bar 42 is hollow as are end weights 44 which enables dumbbell 40 to hold water when submerged. End weights 44 define a plurality of holes 44*a*. Preferably, each plurality of holes 44*a* face in the same direction so both end weights 44 retain water when holes 44*a* face upward. In one embodiment, end weights 44 have an end cap 46 releasably attached to end weight 44. In another embodiment, reducers 45 may be attached both to bar 42 and end weight 44 to attach end weight 44 to bar 42. FIG. 2 depicts a preferred embodiment in which end caps 46 include a plurality of straight edges or sides to prevent rolling of dumbbell 40 along a floor, ground, etc.

Preferably, devices 10 and 40 and ancillary parts are fabricated from such suitable plastics as HPE although person of skill in the art will recognize that other materials may be used.

Figure 3:
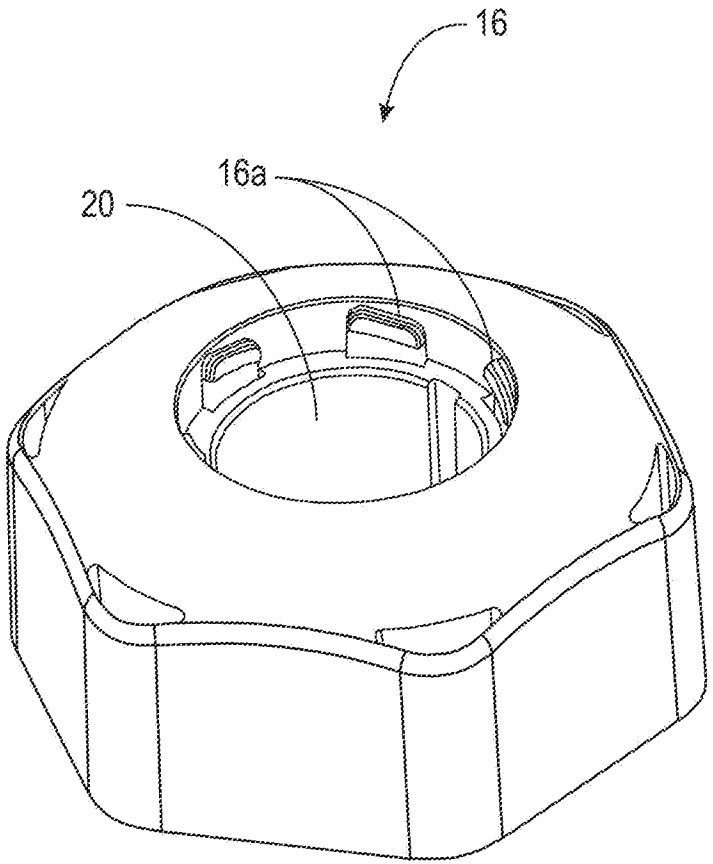
FIG. 3 is a top perspective view of the end cap that encloses the end weights in the inventive water weight training device.

FIG. 3 is a top perspective view of end cap 16. Opening 20 is at the center of end cap 16. If cap 16 is dome shaped as shown in FIG. 3, opening 20 is preferably located at the apex of the dome. If cap 16 is flat, opening 20 is preferably located at the center of cap 16. Wedges 16*a* interact with similar wedges in the end plug with the same slope to form a sealed cap 16.

Figure 4:
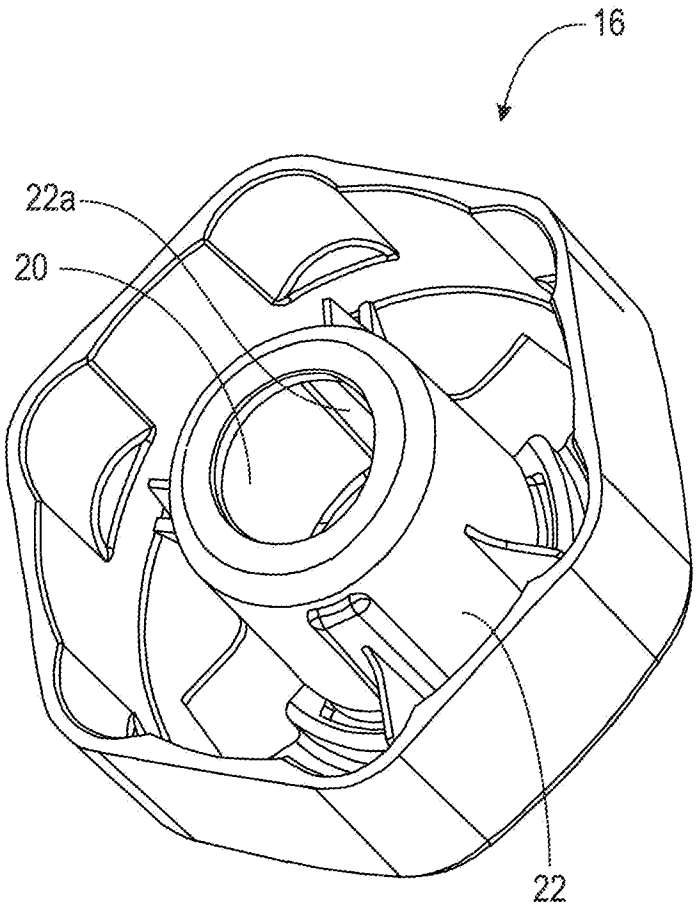
FIG. 4 is a bottom perspective view of the end cap.
Figure 5:
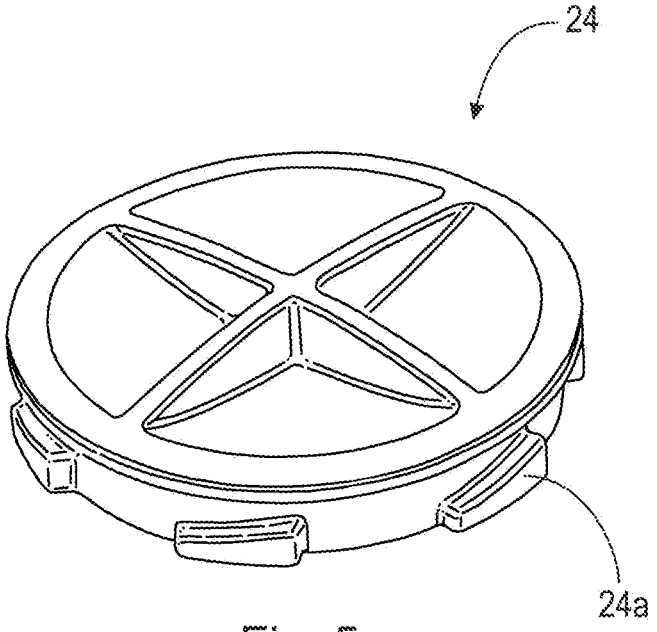
FIG. 5 is a top perspective view of the locking end plug used to seal the end of the end cap.

FIG. 4 is a bottom perspective view of end cap 16. Receiver 22 extends from cap 16 and defines the inner end of opening 20. Channel 22*a* runs along the length of receiver 22 and receives side extension 30 that extends from handle cap 26 (not shown in FIG. 4) as described below. FIG. 5 is a top perspective view of locking end plug 24 which rotates into opening 20 so that wedges 24*a* of end plug 24 slip between wedges 16*a* to form a water-tight seal on the end of end cap 16.

Figure 6:
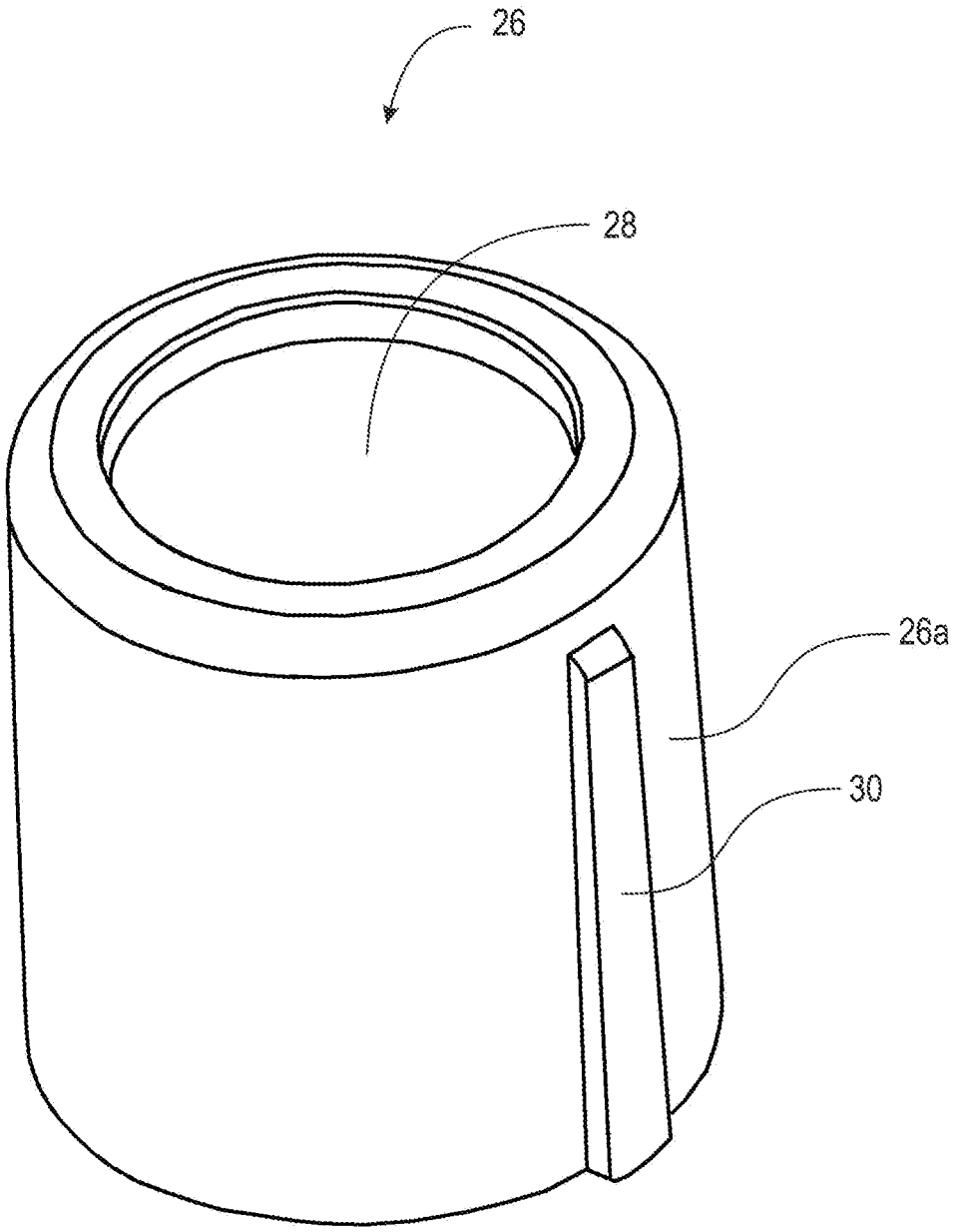
FIG. 6 depicts the handle cap with an opening and a side extension obtruding from the side wall of the handle cap.

FIG. 6 depicts handle cap 26 with opening 28 and side extension 30 ("extension 30") obtruding from side wall 26*a* of handle cap 26. One end of opening 28 fits into receiver 22 of end cap 16 so that extension 30 fits into channel 22*a* to hold handle cap 26 in place inside receiver 22. The other end of opening 28 receives bar 12 or single bar 42 to form a hollow channel from receiver 22 of end weight 14 or 44 that is sealed to hold water. It will be recognized that bars 12 and 42 may fit into opening 28 (male friction fitting) or opening 28 may fit over bars 12 and 42 (female friction fitting). Adhesives and/or sealants known to those having skill in the art may be used to ensure a proper seal to hold the water in a fixed attachment of end weight 14 or 44 to bars 12 or 42, respectively.

Figure 7A:
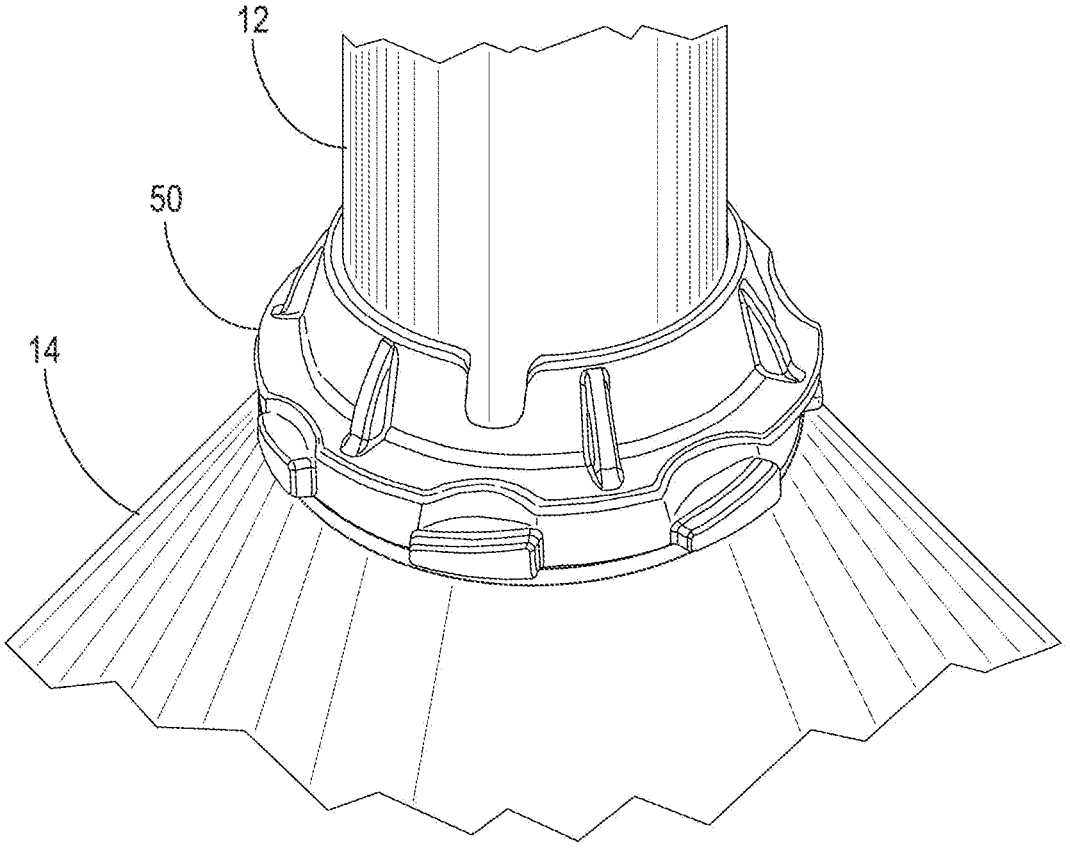
FIG. 7A is a side view of a lock ring releasably a bar of the weight training device against an end weight.
Figure 7:
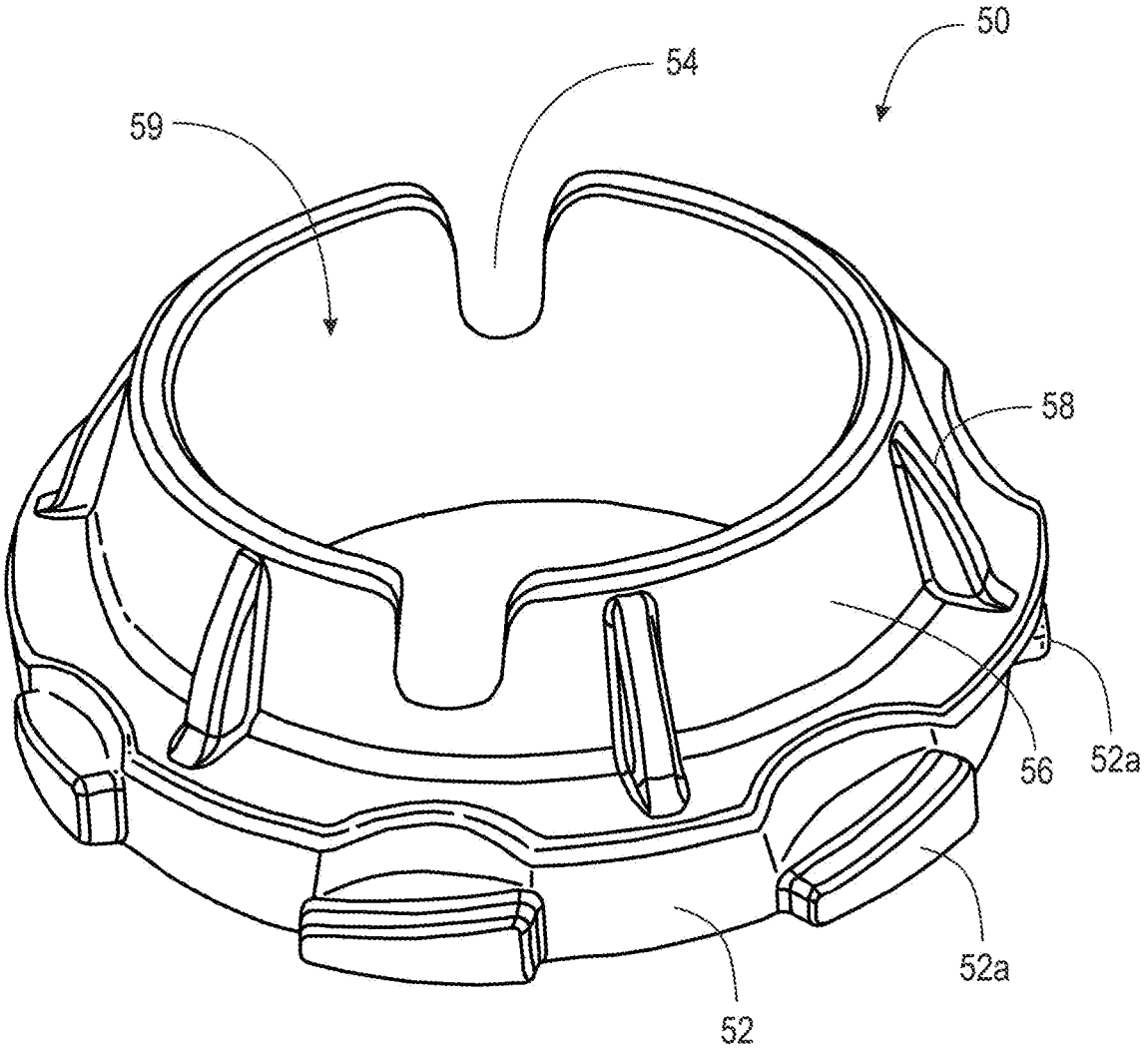
FIG. 7 is a top perspective view of the lock ring used to attach and seal the end weight to the bar.
Figure 8:
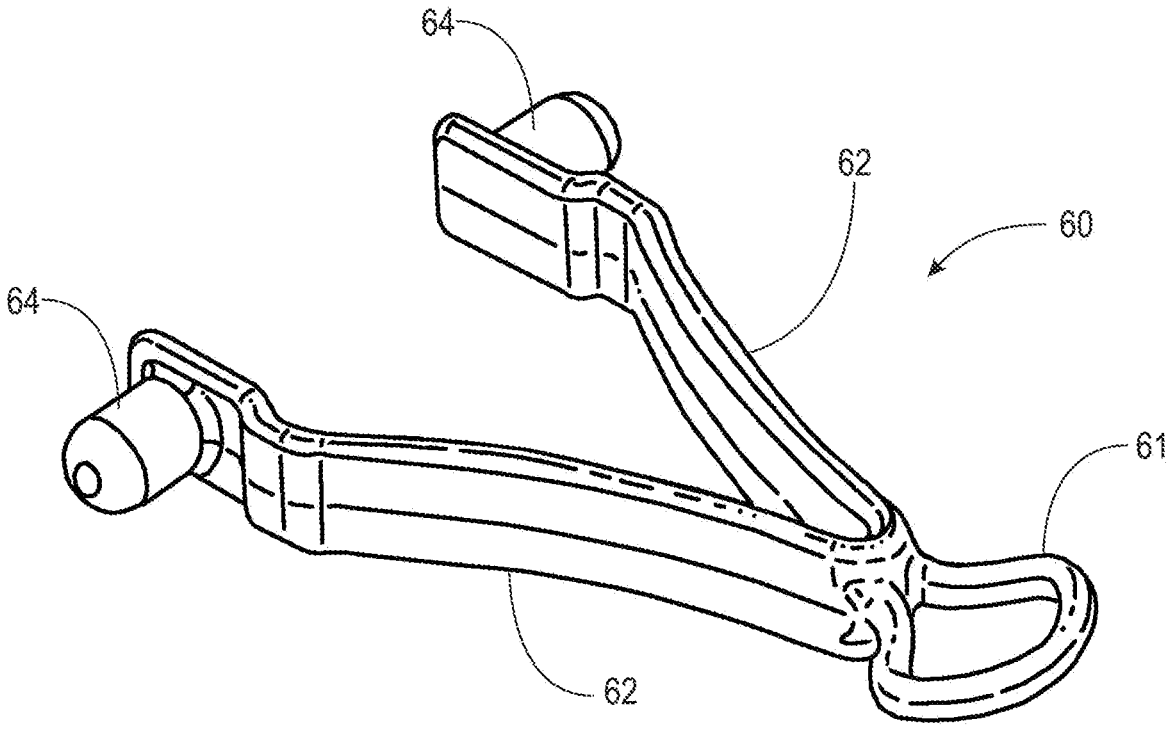
FIG. 8 depicts a V-shaped spring clip used to hold the lock ring in place when it is in the sealed position.

FIG. 7 is a top perspective view of lock ring 50. Lock ring 50 releasably attaches end weight 14 to bar 12 and also seals the water within end weight 14 to prevent leaking between end weight 14 and bar 12. Lock ring 50 includes wedges 52*a* located on peripheral edge 52 and notches 54 located 180 degrees from each cut into wall 56. Tabs 58 facilitate rotation of lock ring 50 by a user. FIG. 8 depicts spring clip 60 ("clip 60") which includes two legs 62 jointly held at base 61 and extending from base 61 to form a V shape. At the end of each leg 62 are knobs 64 which protrude outwardly from legs 62. Space 59 is the space into which hollow bar 12 is inserted during assembly (and refilling) of exercise device 10.

To seal bar 12 and end weight 14, lock ring 50 is placed in opening 20 of end cap 16 and rotated until wedges 52*a* fall between wedges 16*a* to form a water-tight seal as see in FIG. 7A. Spring clip 60 is positioned inside bar 12 with each knob 64 inside holes (not shown) placed in bar 12 to hold clip 60 in position. As lock ring 50 is rotated, notches 54 come into position over the holes allowing knobs 64 to protrude through notches 54 to hold lock ring 60 in the sealed position. To unseal lock ring 60, the user presses in knobs 64 and rotates lock ring 50 until lock ring wedges 52*a* move from between end cap wedges 16*a*. Persons of skill in the art will recognize that lock rings 50 and spring clip 60 can be used in a similar, if not identical, manner to seal end weights 44 to bar 12 to prevent leakage of water from end weights 44 in dumbbell 40.

Figure 9B:
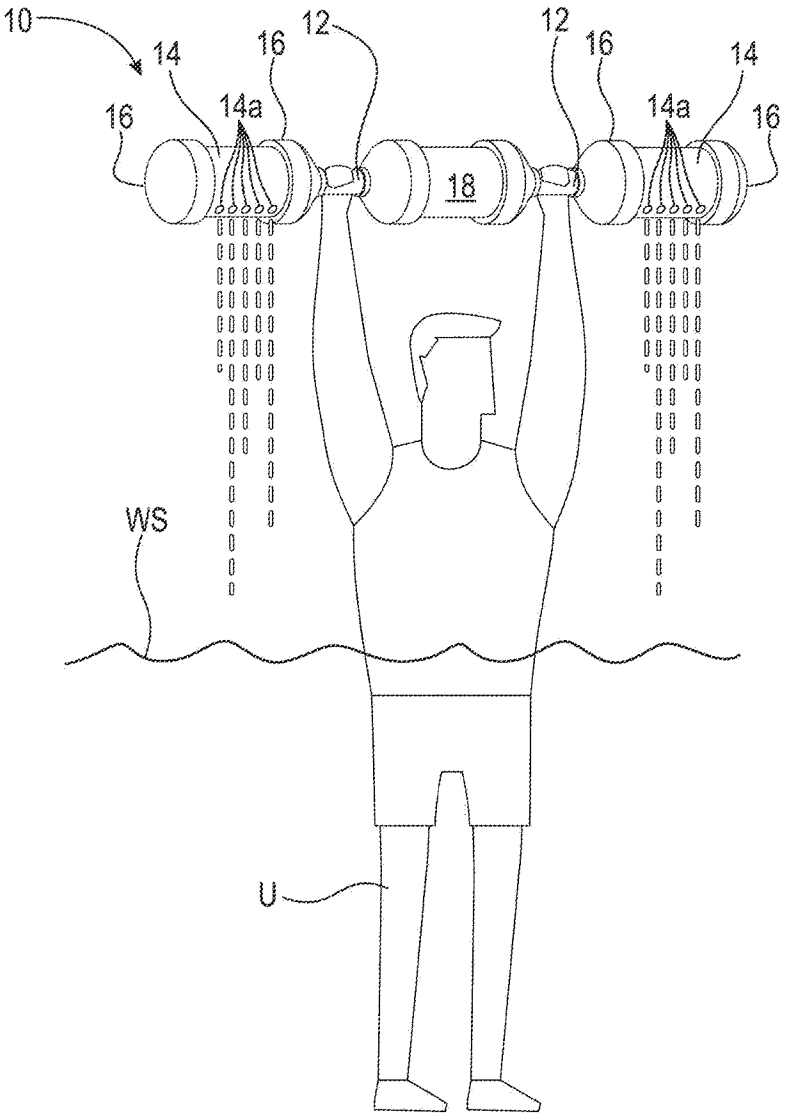
FIG. 9B shows a user rotating the inventive device out of the water to allow water to drain out of the holes in the end weights.
Figure 9A:
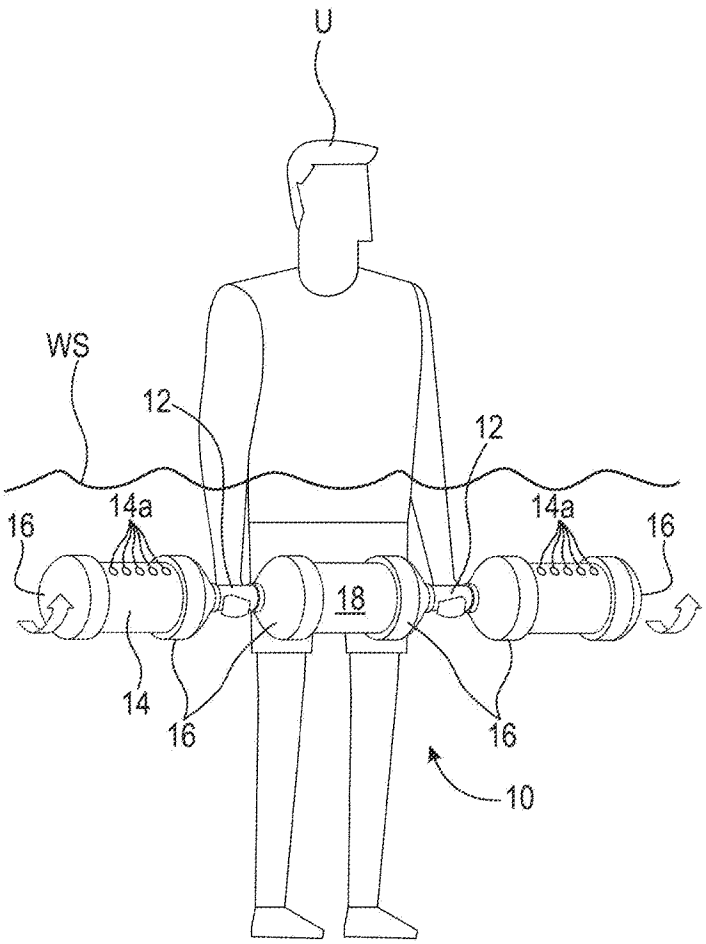
FIG. 9A shows a user holding the inventive device under the water surface to allow water to flow into holes in the end weights.

The plurality of holes 14*a* in end weights 14 allow a user to use device 10 to combine the advantages of water weight training device 10 in the water with the effects of eccentric weight training as discussed above. FIG. 9A shows user U holding device 10 under the water surface WS to allow water to flow into holes 14*a*. The arrows indicate user U has rotated device 10 so holes 14*a* face upward so end weights 14 hold the maximum amount of water. User U may keep holes 14*a* facing upward and/or out of the water and use device 10 as a typical barbell type weight training device. Alternatively, device 10 may be rotated downward as seen in FIG. 9B to allow some or all of the water to be drain through holes 14*a* as seen in FIG. 9B.

Figure 10A:
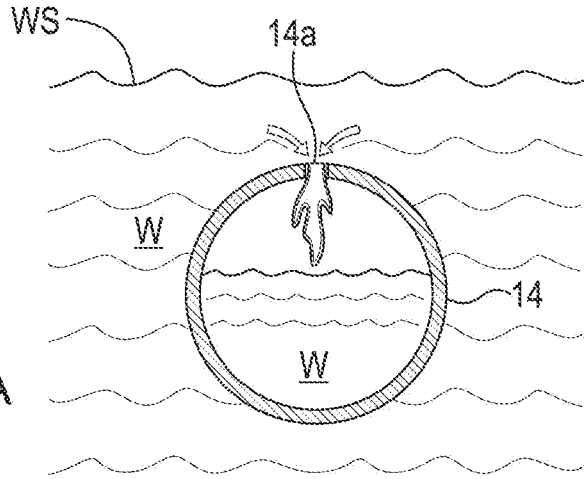
FIG. 10A depicts water filling the end weight when the plurality of holes face in an upward direction when underwater.
Figure 10B:
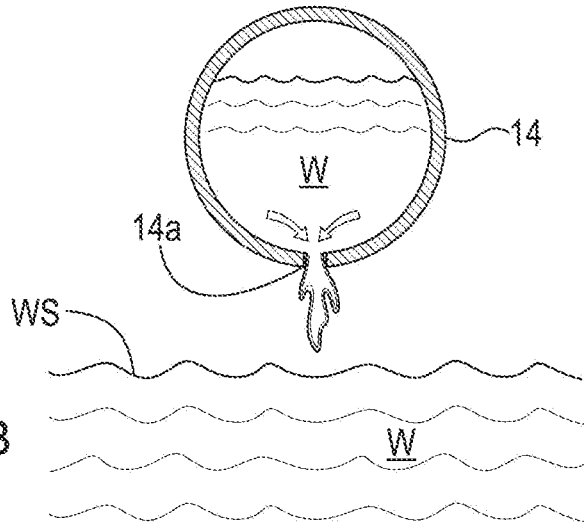
FIG. 10B depicts water pouring out of the end weight when the plurality of holes face in a downward direction when above the surface of the water; and, FIG. 10C shows the holes at a "9 o'clock" position demonstrating some water can be retained in end weights depending on their degree of rotation.
Figure 10C:
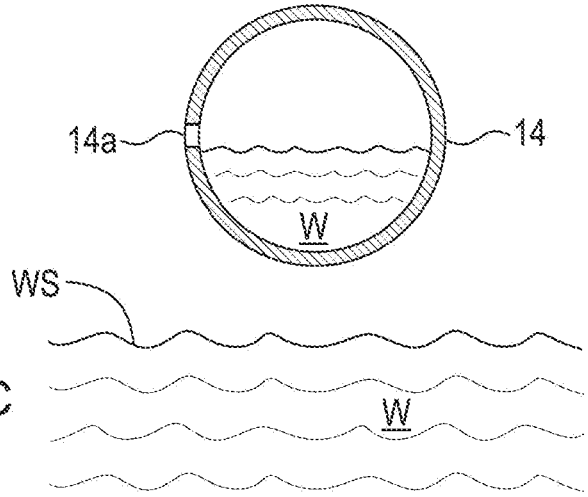

The advantage regarding eccentric training in using device 10 is that user U can adjust the weight of the water in end weights 14 by controlling the amount of rotation of device 10 that takes place during the eccentric (muscle stretching) phase of an exercise. As user U repeats an exercise, the muscle gets fatigued and it becomes more difficult to allow the eccentric phase to proceed as slowly as it should to achieve maximum benefit. By draining some water and thus removing weight, user U can perform more repetitions (reps) before the muscle is finally exhausted, i.e., the muscle cannot work any longer without rest. This can be controlled by the amount of rotation applied—greater amounts of rotation of holes 14*a* from the upward facing orientation will release more water from end weights 14. In addition, at the end of the rep, end weights 14 can be filled by dipping device 10 under water. Again, by controlling the rotation, the amount of water entering end weights 14 can be controlled without having to stop an exercise to adjust weights. FIGS. 10A and 10B show how the rotation and orientation of holes 14*a* enable water to enter or leave end weights 14. FIG. 10C shows holes 14*a* at a "9 o'clock" position demonstrating some water can be retained in end weights 14 by user U depending on to what degree end weights 14 are rotated. Persons of skill in the art will recognize that the same advantage regarding eccentric weight training can be found when using dumbbell(s) 40 having end weights 14 with a plurality of holes 14*a* as seen in FIG. 2.

It will be recognized that user U can increase resistance weight by hanging weights from bar 12 while still retaining the advantages gained by using device 10 with its hollow end weights 14 and holes 14*a*.

Thus, it is seen that the objects of the invention are efficiently obtained, although changes and modifications to the invention should be readily apparent to those having ordinary skill in the art, which changes would not depart from the spirit and scope of the invention as claimed.

I claim:

1. An aquatic weight training device comprising:

at least one hollow bar having first end and a second end;

a pair of hollow end weights attached to said at least one hollow bar, one of said pair of hollow end weights attached to said first end and one of said pair of hollow end weights attached to said second end;

wherein each of the pair of hollow end weight includes a pair of end caps attached to and enclosing each one of said pair of hollow end weights;

a plurality of holes defined by one side of each of said pair of hollow end weights;

wherein said aquatic training device is configured to receive a liquid poured into said at least one hollow bar through at least one of said pair of hollow end weights.

2. The aquatic weight training device of claim 1 further comprising a middle weight and wherein said at least one hollow bar comprises two hollow bars, each of said two hollow bars having a first end and a second end and wherein each one of said first ends is attached to one of said pair of end weights and each of said second ends is attached to said middle weight.

3. The aquatic weight training device of claim 2 wherein each of said pair of hollow end weights is fixedly attached to said first end of said at least two hollow bars.

4. The aquatic weight training device of claim 2 wherein each one of said pair of end caps includes an end plug releasably attached to said respective end cap of the pair of end caps.

5. The aquatic weight training device of claim 2 wherein each one of said pair of end caps has a plurality of straight edges.

6. The aquatic weight training device of claim 2 further comprising at least one additional weight attached to said aquatic weight training device.

7. The aquatic weight training device of claim 2 further comprising a plurality of lock rings, wherein each one of said plurality of lock rings releasably seals each one of said pair of hollow end weights and said middle weight to one of said at least one hollow bars.

8. The aquatic weight training device of claim 1 wherein each of said pair of hollow end weights is fixedly attached to said at least one hollow bar.

9. The aquatic weight training device of claim 1 wherein each one of said pair of end caps includes an end plug releasably attached to said respective end cap of the pair of end caps.

10. The aquatic weight training device of claim 1 wherein each one of said pair of end caps has a plurality of straight edges.

11. The aquatic weight training device of claim 1 further comprising at least one additional weight attached to said aquatic weight training device.

12. The aquatic weight training device of claim 1 further comprising a plurality of lock rings, wherein each one of said plurality of lock rings releasably seals each one of said pair of hollow end weights to said at least one hollow bar.

* * * * *